United States Patent [19]

Gabriel et al.

[11] Patent Number: 4,905,601

[45] Date of Patent: Mar. 6, 1990

[54] EXPLOSIVE ENTRY AND CUTTING DEVICE AND A METHOD OF EXPLOSIVE ENTRY AND CUTTING

[75] Inventors: Roy E. Gabriel, Mission; Alf G. Arneson, Port Coquitlam, both of Canada

[73] Assignee: Canadian Patents and Development Ltd., Ottawa, Canada

[21] Appl. No.: 201,037

[22] Filed: Jun. 1, 1988

[30] Foreign Application Priority Data

Jun. 22, 1987 [CA] Canada ..... 540286

[51] Int. Cl.[4] ..... F42B 1/02

[52] U.S. Cl. ..... 102/307; 102/310; 102/476; 102/302; 102/303

[58] Field of Search ..... 102/306–310, 102/476, 312, 313, 302, 303

[56] References Cited

U.S. PATENT DOCUMENTS

| | | | |
|---|---|---|---|
| 3,838,643 | 10/1974 | Austin et al. | 102/307 X |
| 4,151,798 | 5/1979 | Ridgeway | 102/307 X |
| 4,499,828 | 2/1985 | Honodel | 102/306 X |
| 4,649,825 | 3/1987 | Quick et al. | 102/307 |
| 4,693,181 | 9/1987 | Dadley et al. | 102/307 |
| 4,724,105 | 2/1988 | Owen | 102/307 X |

*Primary Examiner*—Peter A. Nelson

*Attorney, Agent, or Firm*—Juliusz Szereszewski

[57] ABSTRACT

This invention relates to an explosive-containing device for cutting dense material, the device being particularly useful in forced entry situations, e.g. in law enforcement situations or where an immediate entry into a burning building through its wall is required.

15 Claims, 1 Drawing Sheet

EXPLOSIVE ENTRY AND CUTTING DEVICE AND A METHOD OF EXPLOSIVE ENTRY AND CUTTING

DESCRIPTION OF THE PRIOR ART

For many years, explosive cutting and explosive entry have relied upon shaped explosive charges as distinct from bulk charges. The shaped charge principle, developed by Charles Munroe at the end of the 19th century, is based on the characteristics of shock waves produced when a shaped explosive is detonated. When an explosive charge is placed against a layer of material, e.g. steel, concrete or stone, the shock waves may be directed by the shape of the explosive material, so as to form twin convergent shock wave fronts. The convergent wave fronts are refracted at the surface of the target and reflected from the opposite surface, whereby tensile forces are generated along the centre plane between the shock wave fronts. The tensile forces, depending on several factors such as the shape of the explosive charge, usually resembling in cross-section a sloped roof or inverted V-shape, the thickness of the target and, of course, the amount of explosive can produce a relatively clear linear cut as opposed to fracturing in the case of bulk explosive charge.

A number of devices have been used to date based on the Munroe effect. A so-called linear cutting charge, hereinafter called LCC, also known as "flex linear", comprises an explosive filling encased in an extruded soft, V-shaped metal sheath. The material of the sheath consists mostly of lead. One of the components of the linear cutting charge is expanded polystyrene, and this material produces noxious fumes during combustion.

Another device, described for instance in the New Scientist, Apr. 17, 1986, p. 28 and called Shock Wave Refraction Tape, hereinafter referred to as SRT, consists of an elongated wave-shaping element, triangular in cross-section, covered by a layer of explosive which therefore has in cross-section a V-shape analogous to the shape of the wave-shaping element. The element is a strip of magnetic rubber, enabling the SRT to be attached to steel elements, wherein the wave-shaping element is positioned between the target and the explosive.

Many devices have also been known for use in blasting rock, e.g. in quarries. Those devices require blasting holes to be drilled for positioning an explosive-containing device therein. Directional blasting of rock may be achieved, for instance, using a method and device described in U.S. Pat. No. 4,090,447 granted May 23, 1978 (Johnsen). The device comprises a blasting tube crescent-shaped in cross-section. The blasting tube has a longitudinal air space separated from the explosive which is positioned within the crescent shape of the tube. When positioned in a bore hole, the explosive is adjacent to its wall on one side and separated from the other side of the hole by the air space. During detonation, the air cushion receives a part of the forces of the blast, thus delaying the effect of the blast onto the side of the rock opposite to that on which the explosive is located in the bore hole.

It is also known to use a stemming material in the art of directional blasting. Stemming material such as water or sand is used to fill a blasting tube which is then positioned in the bore hole together with an explosive. The stemming material receives a part of the explosive forces during detonation while the material to be blasted receives another part of the explosive forces. Thus, the blast is reflected/directed in the direction opposite to that in which the stemming material is oriented in the bore hole.

There is a need for a forced entry device which, when used, would sever a wall or similar object in a controlled manner. Known devices such as LCC have some disadvantages, e.g. when detonated, LCC sprays molten lead both towards the target and towards the operator. The styrofoam used in LCC causes a fireball emitting highly toxic fumes.

STATEMENT OF INVENTION

According to the present invention, there is provided a method and a device for explosive entry or cutting a dense material such as concrete. The device comprises a backing element comprising a layer of a substantially incompressible material such as e.g. water or sand. The layer is V-shaped in cross-section, the V-shape defining two legs and a cavity therebetween. An explosive charge is accommodated in the cavity and secured in place. The explosive charge has in cross-section a V-shape conforming to that of the cavity. The layer of the incompressible material may be self-contained or encased by an envelope having a V-shape, generally corresponding to that of the incompressible material.

Preferably, the envelope is made of a relatively light and rigid material such as a plastic. The cavity between the legs of the V-shape is thus defined by the external walls of the envelope to which the explosive charge is attached and secured in a mating relationship, e.g. by an adhesive. The envelope may be of a longitudinal shape and it may form a closed circuit, e.g. a geometrical figure. It is essential that the backing element extends the entire length of the explosive material accommodated in its cavity.

Depending on its length and shape, the device may be used for effecting a linear cut or for breaking a portion of the surface of an object. The method of effecting an explosive cut or break comprises the steps of contacting the device as described above with an object to be broken or cut, then, if necessary, applying a pressure onto the device in order to ensure a positive contact therebetween, and then detonating the explosive charge of the device.

The positive contact between the device and the object is essential in order to ensure that the forces of the detonation are not dissipated to a large degree through the gaps between the legs of the device and the object to be cut or broken.

It will be appreciated that a novel combination of known means has been provided in that the explosive charge is backed by a layer of an incompressible material the shape of which is generally corresponding to that of the explosive charge, and that an air space is provided between the V-shaped explosive and the object to be breached while the explosive is virtually sealed between the backing element and the object before the detonation.

BRIEF DESCRIPTION OF THE DRAWINGS

In the drawings which illustrate a preferred embodiment of the device of the invention.

DESCRIPTION OF THE PREFERRED EMBODIMENT

Figure 1:
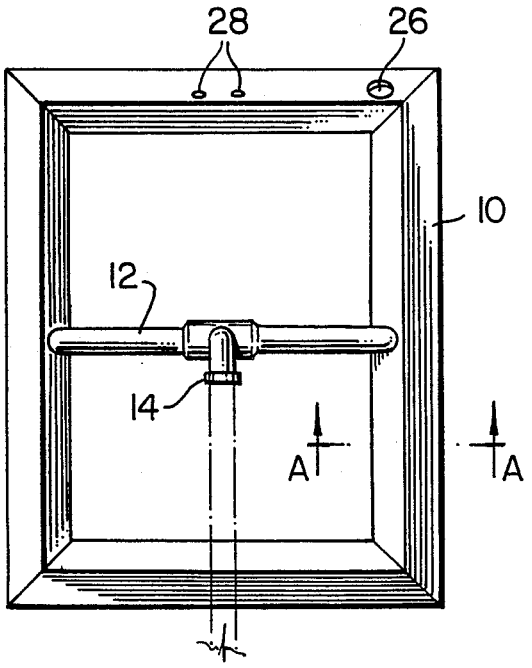
FIG. 1 is a plan view of the device as adapted to cut a rectangular opening in a wall.
Figure 2:
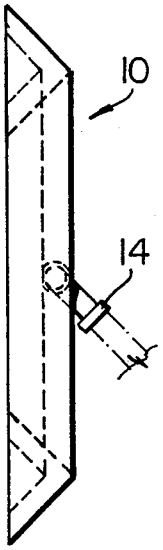
FIG. 2 is a side view of the device.

Referring now to FIG. 1 and FIG. 2, a device for explosive entry is illustrated as having a generally rectangular shape of a size equivalent to the size of an opening to be cut in a wall of a building etc. in a forced entry situation. The device comprises a frame 10 made of PVC. A tubular bracket 12 is permanently secured to the frame 10 to facilitate the positioning of the device against a vertical wall. To this end, the bracket 12 is provided with a tubular three-way connector 14. The device can be positioned and pressed against a vertical wall using a propping element, not illustrated, engaged with the connector 14 and supported on a horizontal surface, e.g. on the ground.

Figure 3:
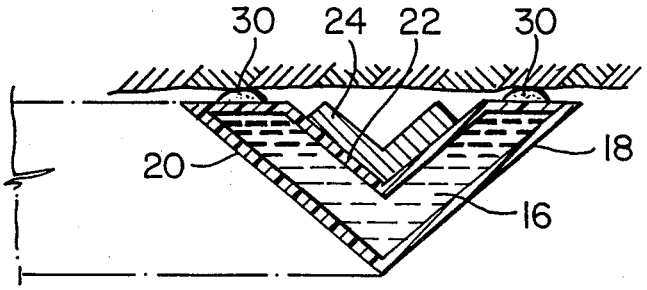
FIG. 3 is a cross-sectional view taken along the lines A—A of FIG. 1.

As can be seen in FIG. 3, the frame 10 is hollow and filled with water. Both the frame 10 and the water layer 16 define in cross-section a V-shape, with two diverging legs 18 and 20. The angle between the legs 18 and 20 in this embodiment is about 90°, but may be substantially different, ranging from about 70° to 160° depending on the particular application, e.g. on the physical properties of the material to be broken. Generally, the angle of the V-shape should be such as to enable the Munroe effect to be used at its full potential, i.e. to accomplish the desired explosive entry using relatively little explosive charge.

The legs 18 and 20 of the frame 10 define a cavity 22. An explosive charge 24 is disposed in the cavity 22 along its walls and secured thereto by means of an adhesive. The explosive is, for instance, PETN or pentaerythrite tetranitrate. In order to attain the abovementioned Munroe effect, the explosive charge 24 is also V-shaped, the shape corresponding to that of the cavity 22.

The frame 10 has a filling opening 26 through which it can be filled with water. Two detonators 28 are also installed in the frame 10 and connected with the explosive charge 24. The wiring used for detonating is not shown in the drawing.

It is well known that detonation forces extend in all directions, and thus may dissipate through gaps, if left, between the device and the surface of an object to be broken.

In order to reduce the losses, the ends of the legs 18 and 20 of the frame 10 are chamfered so as to define a common plane, virtually parallel to the surface of the object that the frame is positioned against, as shown in FIG. 3. A sealing element 30, made of rubber of another resilient material, extends over both legs 18 and 20 along the length of the frame 10.

In order to use the device, the frame 10 is filled with water or another incompressible material. The device is then positioned against the object to be demolished in a controlled manner. It is generally advantageous to exert a certain pressure onto the device to improve the contact between its legs and the object, wherein the sealing elements 30 play an important role. For securing the device in position, either the bracket 12 may be used in connection with a prop, or the device may be supported by means of an assault ladder when the device is to be positioned at a relatively high level. Following those steps, the explosive charge is detonated.

As mentioned above, the detonation forces extend in all directions simultaneously. Due to the tamping effect of the water layer, the forces are in part directed towards the target at an angle so as to promote the cutting effect. The detonation forces destroy the device, but the resulting fragmentation of the materials used does not pose any significant danger, neither to the operator nor to the people behind the wall to be breached. This is very important in a hostage situation where human lives should be saved.

The device described hereinabove is an embodiment of the invention particularly suitable for use by special weapons assault teams or emergency response teams, e.g. in a hostage situation. It may also be used by firemen where an entry into a burning building through its wall is necessary. The general size and shape of the device may be easily adapted to particular applications. By way of example, the device may form a triangle, circle or another geometric figure.

A further embodiment of the present invention may be a device constituting an elongated linear segment. In this form, the device may be used for cutting, e.g. of concrete blocks or steel beams.

According to tests conducted by the inventors, the provision of the tamping layer contributes to as much as 75% reduction of the amount of explosive used as compared to an analogous case with no tamping material used as backing for the explosive charge.

Water is preferable over sand as a stemming material due to the safety of its use and the facility of filling. Moreover, it is conceivable to provide a device where the tamping layer is rigid enough not to necessitate the use of an envelope.

The embodiments of the invention in which an exclusive property or privilege is claimed are defined as follows:

1. A device for controlled demolition, cutting or breaking through a target, which comprises (a) a frangible backing element comprising a layer of a substantially incompressible innocuous material, the layer and the backing element being V-shaped in cross-section thus defining two legs and a cavity therebetween, and (b) an explosive charge having in cross-section a V-shape generally corresponding to the V-shape of the cavity of the backing element, the explosive charge being accommodated and secured in the cavity in mating relationship to said element, (c) the legs of the backing element being adapted to contact the surface of the target so that the explosive charge is positioned between the backing element and the target, (d) the V-shape of the backing element and of the charge being such as to cause the energy of the explosive charge, when exploded, to be reflected partly by the backing element towards the target and concentrate the energy substantially in a place between the legs of the backing element.

2. A device according to claim 1, wherein the backing element further comprises an envelope containing the layer of the incompressible material.

3. A device according to claim 2 wherein the shape of the envelope in cross-section is generally corresponding to the shape of the incompressible material thereby defining in cross-section two legs and a V-shaped cavity therebetween, the explosive charge being accommodated in the cavity of the envelope and secured to the walls of the cavity.

4. A device according to claim 2 wherein the substantially incompressible material is water.

5. A device according to claim 2 wherein the substantially incompressible material is sand.

6. A device according to claim 2 wherein the envelope forms a geometric figure, the incompressible material and the explosive charge extending virtually the entire length thereof.

7. A device according to claim 3 wherein the free ends of the legs are adapted to contact a substantially flat surface along the entire length of the backing element.

8. A device according to claim 7 wherein the ends of the legs are provided with means for enhancing the adhesion of the legs to the surface of an object to be cut or broken.

9. A device according to claim 1, further comprising means for retaining said device against an object to be cut or broken.

10. A device according to claim 2 wherein the envelope is made of plastic and has a filling opening.

11. A device according to claim 8 wherein the ends of the legs of the envelope are chamfered so as to define a common plane.

12. A device according to claim 8 wherein the ends of the legs are provided with a sealing means along the entire length of the envelope.

13. A method of controlled demolition, cutting or breaking a target which comprises the steps of contacting a device comprising a frangible backing element and an explosive charge with an object to be broken or cut, the backing element comprising a layer of a substantially incompressible innocuous material, both the element and the charge being of a matching V-shape in cross section defining two legs and a cavity therebetween with the explosive charge being accommodated and secured in the cavity, positioning the device so that the cavity and the explosive charge face the object and the legs of the backing element abut its surface, and then detonating the explosive charge.

14. A method as claimed in claim 13 wherein the explosive and the backing element constitute a geometrical figure the shape of which is adapted to the profile of a break or cut to be effected..

15. A method as claimed in claim 13 comprising the pressing of the device against the object to be cut or broken so as to ensure a positive contact between the legs and the surface of the object before detonating said explosive charge.

* * * * *